United States Patent [19]

Markowitz

[11] Patent Number: 4,539,238

[45] Date of Patent: Sep. 3, 1985

[54] TEAR-AWAY WINDOW SHADE

[76] Inventor: Steven L. Markowitz, 719 Greenwich St., No. 2 S., New York, N.Y. 10014

[21] Appl. No.: 620,479

[22] Filed: Jun. 14, 1984

[51] Int. Cl.[3] ..... A47G 5/02; B65D 65/28

[52] U.S. Cl. ..... 428/43; 28/170; 160/263; 428/102; 428/906

[58] Field of Search ..... 160/263; 428/304.4, 428/43, 906, 253-254, 102; 28/170; 66/172 R

[56] References Cited

U.S. PATENT DOCUMENTS

| | | | |
|---|---|---|---|
| 1,606,083 | 11/1926 | Klein | 160/384 |
| 1,898,686 | 2/1933 | Rice | 160/263 |
| 2,943,676 | 7/1960 | Grenci | 160/368 R |
| 3,099,916 | 8/1963 | Rosenbaum | 160/323 R |
| 3,203,468 | 8/1965 | Gossling et al. | 160/323 R |
| 3,299,944 | 1/1967 | Gossling et al. | 160/263 |
| 3,308,874 | 3/1967 | Anderson | 160/326 |
| 3,563,839 | 3/1971 | Divis | 428/43 |
| 3,580,323 | 5/1971 | Gossling et al. | 160/263 |
| 3,780,921 | 12/1973 | Harp | 225/2 |
| 3,913,655 | 10/1975 | Ogino | 160/84 R |
| 4,006,770 | 2/1977 | Ferguson | 160/263 |
| 4,102,383 | 7/1978 | Miller | 160/263 |
| 4,102,384 | 7/1978 | Goesling et al. | 160/263 |
| 4,102,385 | 7/1978 | Miller | 428/43 X |
| 4,298,645 | 11/1981 | Obayashi et al. | 428/253 X |
| 4,298,647 | 11/1981 | Cancio et al. | 428/167 |
| 4,329,386 | 5/1982 | Samowich | 428/196 |
| 4,380,564 | 4/1983 | Cancio et al. | 428/167 |
| 4,409,275 | 10/1983 | Samowich | 428/138 |

*Primary Examiner*—Henry F. Epstein
*Attorney, Agent, or Firm*—Kenyon & Kenyon

[57] ABSTRACT

A window shade comprises a multiplicity of elongate fabric strips connected to one another along their longitudinal edges by means of severable connecting threads. Mounting and weighting rods inserted in respective pockets at the upper and lower end of the multistrip fabric web are adjustable in length to match the width of the window shade upon a reduction thereof owing to a tearing of one or more fabric strips from the body of the window shade web. The window shade web is advantageously provided with a foam backing which contributes in part to the mechanical stability of the shade.

12 Claims, 5 Drawing Figures

TEAR-AWAY WINDOW SHADE

BACKGROUND OF THE INVENTION

This invention relates to a window covering or window shade utilizable, for example, with a spring loaded mounting rod attachable to a window frame at an upper end thereof.

A particularly common kind of window shade comprises a soft vinyl or plastic coated cloth web attached at an upper end to a spring loaded mounting bar or rod. The rod has at its ends a pair of outwardly projecting lugs which are insertable into corresponding slots of respective wall brackets mounted to the upper end of a window frame at opposite sides thereof. Upon the application to the window shade of a force directed downwardly and inwardly, i.e., towards the inside of the room from which the window looks, the window shade is drawn upwardly by a rotary motion of the mounting rod or cylinder. The upward motion of the shade can be arrested by moving the shade into a vertical position.

Window shades of the above-described type had been manufactured with a uniform width until several years ago. In order to adapt the shades to windows of varying widths, it had been the practice to cut the window shades at retail outlets in accordance with window width specifications brought to the stores by the purchasers. This method of adapting window shades to the different types of windows required the provision of a special cutting machine at each retail outlet. In addition, the practice resulted in a considerable waste of time in that consumers were frequently obliged to await the performance of the cutting operation by a retail sales person.

In a relatively new kind of window shade of the above-described general type, a vinyl window shade web is provided with a multiplicity of laterally equispaced lines of perforations extending the length of the web. With this new kind of window shade it is no longer necessary to perform a cutting operation at the retail outlet. The consumer juxtaposes the window shade to the window to determine the appropriate width of the shade. The shade is then torn along the line of perforations corresponding to the appropriate window shade width. The mounting bar or rod is commonly a pair of telescoping cylinders, whereby the length of the mounting rod may be adjusted in accordance with the width of the window shade upon separation of a lateral portion by tearing or severing along a line of perforations. Similarly, a weighting rod or bar attached to the window shade web at the lower end thereof may consist essentially of a pair of telescoping cylinders for adjusting the length of the weighting rod in accordance with the width of the window shade.

An object of the present invention is to provide an improved window shade of the above-described general type.

Another object of the present invention is to provide such a window shade of heightened aesthetic value and increased durability.

SUMMARY OF THE INVENTION

A window shade in accordance with the present invention comprises a multiplicity of elongate fabric strips of substantially equal length disposed laterally adjacent to each other in substantially the same plane. A multiplicity of fibers or threads are provided for forming at least one tying link between each pair of adjacent fabric strips to hold the same substantially in contact with one another in the plane of the window shade. The tying fibers or threads are severable upon the manual application of a force exceeding a predetermined threshold, thereby enabling the disengagement and separation of adjacent fabric strips from one another.

In accordance with specific features of the present invention, each fabric strip is knitted, while each connecting fiber threadingly engages the respective pair of adjacent fabric strips in a knitted stitch. Each connecting fiber advantageously has a breadth or diameter sufficiently small to facilitate the severing of the fiber upon the application of a strip separating force to the respective pair of adjacent fabric strips.

Pursuant to another feature of the present invention, the window shade further comprises a layer of foam material bonded to the fabric strips on a back side thereof. The layer of foam material coacts with the connecting fibers to secure the parallel fabric strips to each other, but does not provide a significant increase in the resistance of the window shade web to a shearing force applied to a pair of adjacent fabric strips for separating the strips along the knitted seam formed by the respective connecting fiber.

A window shade in accordance with the present invention is especially durable owing to a formation of the window shade by a fabric material. The same fabric material improves the appearance of the window shade, in part owing to the differences in texture between fabric material and paper or vinyl.

DETAILED DESCRIPTION

Figure 1:
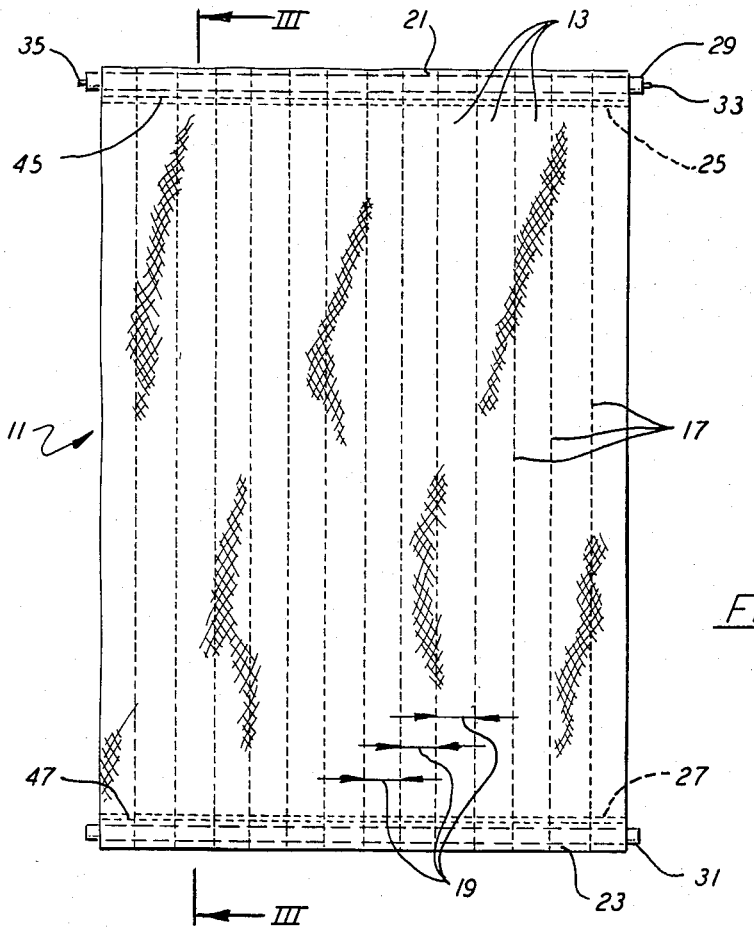
FIG. 1 is a front elevational view of a window shade in accordance with the present invention, showing a multiplicity of fabric strips attached to each other by connecting fibers.

As illustrated in FIG. 1, a window shade web 11 of a window shade in accordance with the present invention comprises a multiplicity of lengthwise coextensive elongate fabric strips 13 laterally juxtaposed to each other in substantially the same plane. Adjacent fabric strips 13 contact one another along respective longitudinal edges 65 (see FIG. 5) and are stitched to one another along a seam or joint 17 defined by the contacting longitudinal edges.

Fabric strips 13 advantageously have a common width 19. Window shade web 11 is provided at opposite ends with a pair of tubular pockets or channels 21 and 23 for receiving respective cylindrical bars or rods 29 and 31. Rod 29 is disposed at an upper end of window shade web 11 and serves to mount the web to a window frame (not illustrated). Mounting or support rod 29 is spring loaded and provided at its opposite ends with a pair of outwardly extending lugs or fingers 33 and 35 which are insertable in slots or recesses of respective mounting brackets (not illustrated) on a window frame at the upper end thereof. Rod 31 serves the dual function of uniformly distributing weight along the bottom end of window shade web 11 and facilitating the raising and lowering thereof. Both rods 29 and 31 have an adjustable length.

Figure 2:
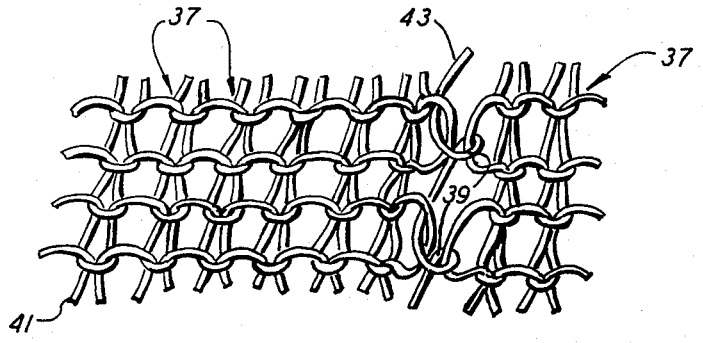
FIG. 2 is a partial detail view of a pair of adjacent fabric strips of FIG. 1, showing a connecting fiber securing the fabric strips to one another.

Window shade web 11 is advantageously produced by means of a knitting machine, the knitted infrastructure of fabric strips 13 being illustrated in the large scale view of FIG. 2. Each fabric strip 13 has a substantially uniform knitted infrastructure throughout its entire length, the knitted stitches 37 of strips 13 being contrastable with the knitted stitches 39 by means of which pairs of adjacent fabric strips 13 are attached to one another at seams 17. Each fabric strip 13 is advantageously composed of a single respective thread or fiber 41, while each pair of adjacent strips 13 are secured to one another by a single connecting fiber 43 which threadingly engages in a multiplicity of knitted stitches 37 the pair of adjacent strips 13 along the contacting longitudinal edges 65 (see FIG. 5) thereof. Threads 41 may be formed of any naturally occurrring or man-made substance, while connecting fiber 43 advantageously consists of a substantially transparent synthetic resin material.

A multistrip web continuously produced by a knitting machine and having the above-described infrasturcture is cut into standard size segments (e.g., segments 84" in length). Each such segment forms a web 11 for a window shade in accordance with the present invention and has a pair of transversely extending edges 25 and 27 which are folded back upon the body of web 11 and stitched thereto along seams 45 and 47 to form pockets 21 and 23. Prior to the folding of web 11 at end 25 thereof to form pocket 21 the upper end of the web is advantageously attached to an outer member 85 (see FIG. 4) of rod 29 along the length thereof by means of glue or other adhesive. The upper end of the web 11 is then rolled about rod 29 and stitched along seam 45 to form pocket 21.

The web 11 is advantageously provided on a back or rearward facing surface 49 with a layer 51 of insulating material such as a synthetic foam. Insulating layer 51 may be attached to fabric web 11 by means of a conventional bonding process, e.g. a process utilizing a flame, whereby fabric web 11 and insulating layer 51 together form a laminate material. Layer 51 performs a number of distinct functions including heat or temperature insulation, sound insulation and mechanical support for fabric strips 13.

Figure 5:
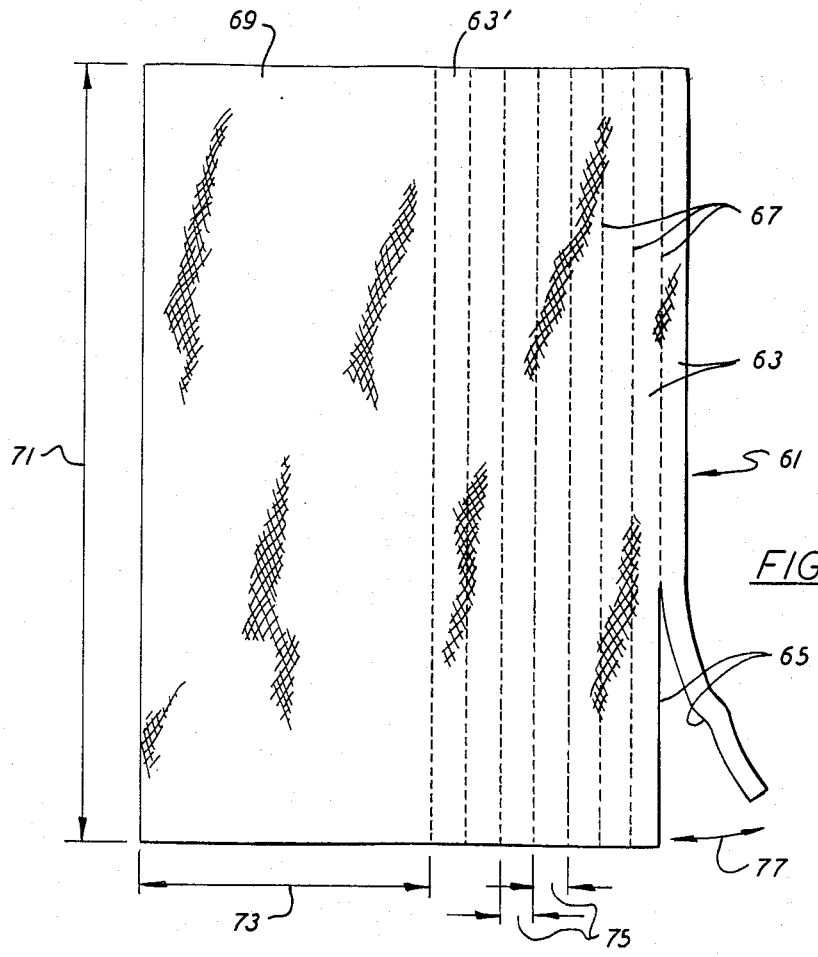
FIG. 5 is a front elevational view, similar to FIG. 1, showing a step in the installation of a window shade in accordance with the invention.

As illustrated in FIG. 5, a window shade in accordance with the present invention advantageously includes a window shade web 61 having a multiplicity of lengthwise coextensive and widthwise uniform elongate fabric strips 63 and a large web portion 69 having a length 71 substantially equal to the length of fabric strips 63 and a width 73 several times greater than the common width 75 of fabric strips 63. Strips 63 are laterally juxtaposed to one another, each pair of adjacent strips 63 having a pair of contacting longitudinal edges 65 along which the pair of strips are stitched to one another to form a seam 67. As heretofore described with respect to FIGS. 1 and 2, strips 63, as well as web portion 69, are advantageously formed at the same time by a knitting machine, adjacent strips 63 being attached to one another by a respective connecting fiber (not illustrated) knittingly threaded to the respective adjacent strips 63 along the contacting longitudinal edges 65 thereof. Web portion 69 is similarly connected to an adjacent fabric strip 63'.

Width 73 of web portion 69 is selected to match the narrowest window for which a window shade in accordance with the present invention is likely to be purchased. Length 71 of web portion 69 and fabric strips 63 is preferably of such a magnitude that the window shade 61 would be at least as long as the tallest window for which such a window shade would be purchased.

Figure 3:
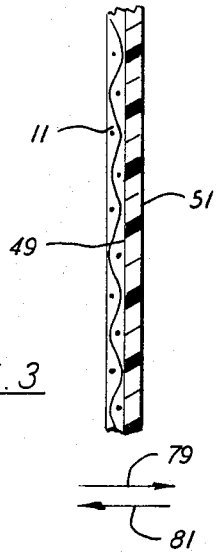
FIG. 3 is a partial cross-sectional view taken along line III—III in FIG. 1.

As illustrated in FIG. 5, window shade 61 (or window shade 11) is adapted by the consumer to the width of a particular window by severing one or more fabric strips 63 (or 13) from the body of the window shade web 61 (or 11) along sewn seals 67 (or 17). Although the severing of a pair of fabric strips 63 or 13 along a joint or seam 67 or 17 may be effectuated by pulling one of the strips away from the other strip in a direction perpendicular to the seam, as indicated by double headed arrow 77 in FIG. 6, it has been found that the tearing process is more easily implemented by exerting a shear type force on the respective pair of adjacent fabric strips in a direction perpendicular to the plane of the web, as indicated in FIG. 3 by arrows 79 and 81. In this fashion connecting fiber 43 (see FIG. 2) will be severed at multiple points along the length of the respective seam 17 or 67. Fiber 43 has a width or diameter which is sufficiently small to enable the severing of the fiber upon the manual exertion of a shearing force as represented by arrows 79 and 81. The strength of fiber 43 is, however, sufficiently great to hold strips 13 or 63 in juxtaposition to one another in the fabric web 11 or 61 in the absence of substantial shearing forces.

Figure 4:
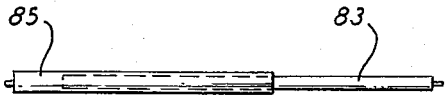
FIG. 4 is a side view of a spring loaded mounting rod included in the window shade assembly of FIG. 1 for mounting the window shade to a window frame.

As illustrated in FIG. 4, mounting rod 29, as well as weighting or gripping rod 31, advantageously takes the form of a pair of telescoping cylinders 83 and 85 which may, for example, be screwably connected to one another for modifying the length of the rod upon an adjustment in the width of the window shade 11 or 61 by a tearing away of one or more fabric strips 13 or 63 along a seam 17 or 67.

It is to be noted that mounting rod 29 need not be spring loaded and that a window shade in accordance with this invention could be raised and lowered by other means, for example, by a pulley assembly. In addition, the window shade fabric may consist of heavy piece goods to which a layer of foam need not be attached.

A window shade in accordance with the present invention not only has the advantages of adjustability with respect to size but also has the heightened aesthetic qualities and great potential for variation inherent in fabric material.

Although the invention has been described in terms of specific embodiments and applications, persons skilled in the art, in light of this teaching, can produce additional embodiments without departing from the spirit of or exceeding the scope of the claimed invention. Accordingly, it is to be understood that the drawings and description in this disclosure are proferred to facilitate comprehension of the invention and should not be construed to limit the scope thereof.

What is claimed is:

1. A window shade comprising:

a multiplicity of elongate fabric strips of substantially equal length disposed laterally adjacent to each other in substantially the same plane; and attachment means including a multiplicity of fibers each threadingly engaging in a knitted stitch a respective pair of adjacent fabric strips along the lengths thereof for forming a tying link between said pair of adjacent fabric strips to hold same substantially in contact with one another, said fibers being separate from the fabric of said strips, said attachment means being deformable, upon the manual application of a force exceeding a predetermined threshold, for severing said link and thereby enabling the disengagement and separation of said adjacent fabric strips from one another.

2. The window shade defined in claim 1 wherein each pair of adjacent fabric strips among said multiplicity of elongate fabric strips are held in position with respect to one another by a single fiber threadingly engaging the respective adjacent fabric strips along the lengths thereof.

3. The window shade defined in claim 2 wherein each strip of said multiplicity of elongate fabric strips is knitted and wherein said single fiber is connected to the respective pair of adjacent fabric strips in a knitted stitch.

4. The window shade defined in claim 2 wherein said single fiber has a breadth sufficiently small to facilitate severing of said single fiber upon the manual application of a strip separating force to the respective pair of adjacent fabric strips.

5. The window shade defined in claim 2 further comprising a layer of foam material bonded to said multiplicity of elongate fabric strips on a back side thereof.

6. The window shade defined in claim 1 further comprising a layer of foam material bonded to said multiplicity of elongate fabric strips on a back side thereof.

7. The window shade defined in claim 2 wherein said multiplicity of elongate strips have colinearly disposed transverse edges, further comprising mounting means for mounting said window shade to a window frame, said mounting means including a rod adjustable in length and attachable to said multiplicity of elongate strips at said colinearly disposed transverse edges.

8. The window shade defined in claim 1 wherein said multiplicity of elongate strips have colinearly disposed transverse edges, further comprising mounting means for mounting said window shade to a window frame, said mounting means including a rod adjustable in length and attachable to said multiplicity of elongate strips at said colinearly disposed transverse edges.

9. A window shade comprising:

a multiplicity of elongate knitted fabric strips of substantially equal length disposed laterally adjacent to each other in substantially the same plane, said fabric strips having at one end substantially colinearly disposed transverse edges defining a top end of the window shade;

attachment means, including a multiplicity of fibers each threadingly engaging in a knitted stitch a respective pair of adjacent fabric strips among said multiplicity of elongate knitted fabric strips, for holding said fabric strips in contact with each other to form a substantially planar web, each of said fibers being severable upon the application of a separating force to the respective pair of adjacent fabric strips held in contact by such fiber; and support means for mounting said web to a window frame, said support means including a rod adjustable in length and attachable to said web along said top end.

10. The window shade defined in claim 9 wherein said elongate knitted fabric strips have additional substantially colinearly disposed transverse edges defining a bottom end of the window shade, further comprising an additional rod adjustable in length and attachable to said web along said bottom end.

11. The window shade defined in claim 9 wherein said support means includes a tubular pocket formed by folding back and stitching said top end to the body of said web along a seam parallel to said transverse edges, said rod including an outer member and an inner member telescopingly seated therein, said pocket surrounding said rod and being attached to said outer member, said inner member being slidably disposed with respect to said pocket.

12. The window shade defined in claim 9 further comprising a layer of foam material bonded to said multiplicity of elongate fabric strips on a back side thereof.

* * * * *